United States Patent [19]

Mathe et al.

[11] 4,368,942

[45] Jan. 18, 1983

[54] KEYED CONNECTOR TO PREVENT INTERMATING WITH A STANDARD CONNECTOR

[75] Inventors: Istvan Mathe; Alan H. Kasper, both of Cicero, Ill.

[73] Assignee: Bunker Ramo Corporation, Oak Brook, Ill.

[21] Appl. No.: 876,326

[22] Filed: Feb. 9, 1978

Related U.S. Application Data

[63] Continuation of Ser. No. 767,799, Feb. 11, 1977, abandoned.

[51] Int. Cl.[3] ..... H01R 13/64

[52] U.S. Cl. ..... 339/186 M; 339/211

[58] Field of Search ..... 339/176 M, 184 R, 184 M, 339/186 R, 186 M, 211

[56] References Cited

U.S. PATENT DOCUMENTS

| | | | |
|---|---|---|---|
| 3,002,176 | 9/1961 | Yopp | 339/184 M |
| 3,636,503 | 1/1972 | Bernutz et al. | 339/186 M |

FOREIGN PATENT DOCUMENTS

| | | | |
|---|---|---|---|
| 237712 | 1/1965 | Austria | 339/186 M |
| 1190333 | 5/1970 | United Kingdom | 339/186 M |

*Primary Examiner*—Neil Abrams

[57] ABSTRACT

A keyed high voltage connector of this invention is adapted to prevent connection to a standard connector having a standard shaped shell and which retains a standard contact mounting insert with a standard length contact supporting portion defined by end walls spaced a standard length by contact supporting walls. Typically, the standard connector may be of a low voltage type whereas the keyed connector carries high voltages which must not be directly connected or accidentally arced over to a seemingly mateable low voltage connector. Alternatively, the standard connector may carry a high voltage and the keyed connector a low voltage. The keyed connector of this invention uses the standard shaped shell and has a contact mounting insert with a contact supporting portion retained within the shell. At ends of the contact supporting portion keying portions are provided which begin at points spaced less than ends of the standard length contact supporting portion and terminate at points longer than ends of the standard length contact supporting portion. These keying portions may be provided as slots of reduced width or extended portions of reduced width. The keying portions are also raised to project above the level of a mating insertion end of the contact supporting portion to prevent arc-over of high voltages between a standard connector and a keyed connector. Also, the shell used with the keyed connector may be externally keyed to provide visual identification and to prevent mating with a standard connector.

9 Claims, 8 Drawing Figures

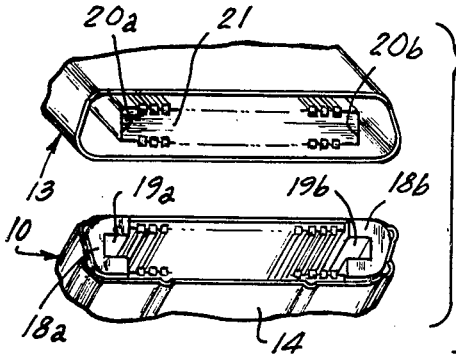
Fig. 1A
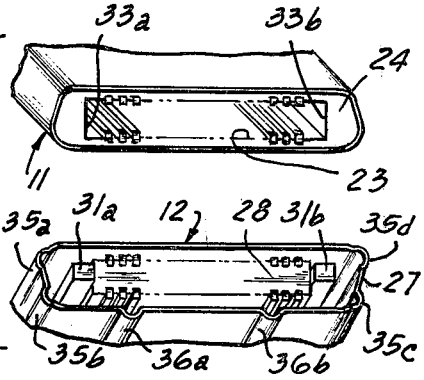
Fig. 1B
Fig. 2A
(PRIOR ART)
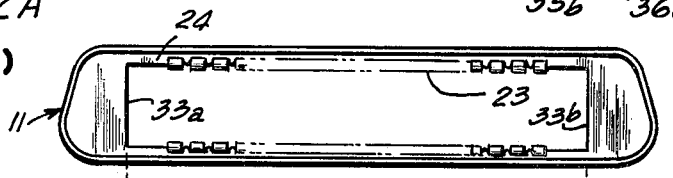
Fig. 2B
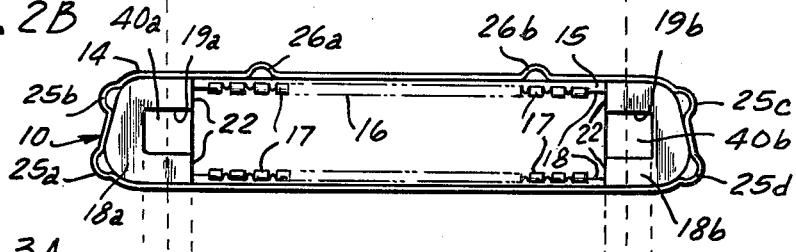
Fig. 3A
(PRIOR ART)
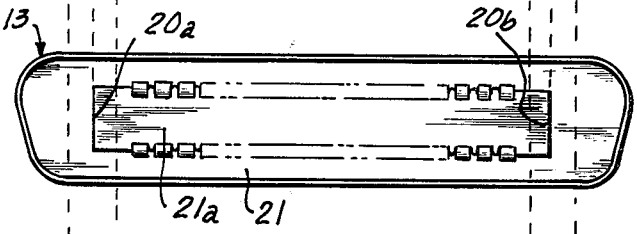
Fig. 3B
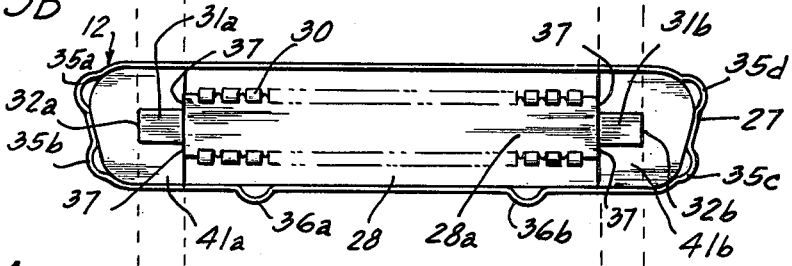
Fig. 4
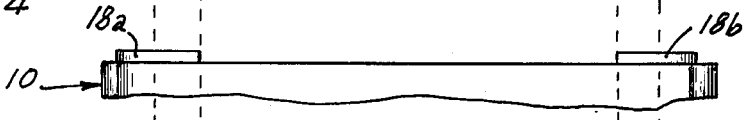
Fig. 5
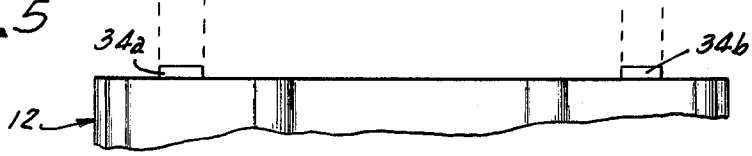

KEYED CONNECTOR TO PREVENT INTERMATING WITH A STANDARD CONNECTOR

This is a continuation of application Ser. No. 767,799, filed Feb. 11, 1977 now abandoned.

BACKGROUND OF THE INVENTION

1. Field of the Invention

This invention relates to keyed connectors and more particularly to keyed connectors having dimensions similar to but which cannot be mated with standard connectors.

2. Description of the Prior Art

Long marketed connector systems commonly known as MICRO-RIBBON connectors (a trademark of Bunker Ramo Corp.) are useful for interconnecting two cables, each having a plurality of wires therein. Such connectors, when embodied as either a plug or a receptacle, have an outer shell which retains an inner contact mounting insert. For a plug, the contact mounting insert has a central, upwardly extending tongue formed of parallel contact-retaining walls and end walls spaced a standard length by the retaining walls. A typical receptacle has a contact mounting insert with an aperture therein formed by parallel contact-retaining walls and end walls spaced a standard length by the retaining walls. The contacts on the contact supporting walls of the plug and receptacle align and mate when the units are plugged together.

In many applications, some of the connectors have low voltages associated therewith and others have high voltages. It is undesirable to permit a situation to exist in which a low voltage connector can be accidentally joined to a non-compatible high voltage connector. In particular, it is advantageous to prevent the mis-mating of data system connectors with telephone system connectors. In such cases, voltage level differences of up to 110 volts can occur. Also, even if the connectors do no exactly mate, the possibility that a conductive contact adjacent an end portion of one of the connectors might be tipped into contact or at least near to some of the contacts of the other connector poses a problem. Also, the contacts of non-compatible connectors may approach each other if an attempted head-on insertion is made. A high voltage arc may then occur when the high and low voltage contacts come sufficiently close together to permit an arc between them. Also, government requirements exist requiring connectors carrying high voltages to be polarized so that they can intermate only with similarly polarized mating halves and thus cannot short out any low voltage non-polarized connectors.

Examples of prior art patents which illustrate the use of keyed plugs and receptacles are Desso et al (U.S. Pat. No. 3,651,444), McDonald (U.S. Pat. No. 3,656,090), Gallagher (U.S. Pat. No. 3,930,705), Bertram et al (U.S. Pat. No. 3,002,175), Wilson (U.S. Pat. No. 3,953,099) and Yopp (U.S. Pat. No. 3,002,176). These patents are not pertinent to this invention since they do not teach the use of the connector system which uses a standard connector dimension but has a contact mounting insert with a contact supporting means which utilizes the keying means of this invention.

SUMMARY OF THE INVENTION

It is an object of this invention to provide a keyed connector embodied as either a plug or a receptacle which will not mate with a non-keyed standard connector.

It is a further object of this invention to prevent a high voltage arc-over between a keyed connector and a standard connector.

It is a further object of this invention to prevent any of the contacts of a keyed connector from approaching or making contact with any of the contacts of a non-keyed, standard connector.

It is another object of this invention to provide a keyed connector which utilizes a standard shell shape and has other dimensions which are similar to a standard connector.

According to the invention, a keyed connector is adapted to prevent connection to a standard connector having a base which retains a contact mounting insert and a standard length contact supporting means defined by end walls which are spaced a standard length by a contact supporting wall. The keyed connector has a contact mounting insert and contact means retained on a base. Keying means are provided adjacent at least one end of the contact supporting means. These keying means begin at a point shorter than one of the ends of the standard length contact supporting means of the standard connector and terminate at a point longer than the end of the standard length contact supporting means of the standard connector. In the case when the connector is a receptacle, the contact supporting means comprises an aperture in the mounting insert and the keying means comprises a slot of width less than the width of the aperture at ends of the aperture. When the connector of this invention is a plug the contact mounting insert comprises a tongue and the keying means comprises an extended end portion at ends of the tongue which has a width less than the width of the tongue. The keying means of the keyed connector of this invention further may have a raised portion which extends beyond a mating insertion end of the contact supporting means. This prevents high voltage arc-over in the event that a high voltage keyed connector is attempted to be inserted into a low voltage standard connector. Furthermore, a standard shaped shell of the keyed connector of this invention may have additional means at front and side locations to enhance alignment of the connectors when mating and to prevent insertion of a keyed plug of this invention into a standard receptacle.

BRIEF DESCRIPTION OF THE DRAWINGS

FIG. 1A is a perspective view of a keyed receptacle of this invention adjacent to a non-keyed standard plug;

FIG. 1B is a perspective view of a keyed plug of this invention adjacent a standard receptacle;

FIG. 2A is a plan view of a standard receptacle of the prior art;

FIG. 2B is a plan view of a keyed receptacle of this invention;

FIG. 3A is a plan view of a standard plug of the prior art;

FIG. 3B is a plan view of a keyed plug of this invention;

FIG. 4 is a side view of the keyed receptacle of FIG. 2B; and

FIG. 5 is a side view of the keyed plug of FIG. 3B.

DESCRIPTION OF THE PREFERRED EMBODIMENTS

As shown in FIGS. 1A and 1B, a keyed receptacle 10 or keyed plug 12 of this invention carrying a high voltage, for instance, will not mate with respective standard plug 13 or standard receptacle 11 carrying a low voltage. The characteristics of the keyed receptacle 10 and keyed plug 12 which prevent mating with the standard plug or receptacle are more clearly shown in FIGS. 2A through 5 wherein the various dimensions can be compared by use of the vertical dashed dimension lines connecting FIGS. 2A through 5.

FIGS. 2A and 2B show side by side relationships between a prior art receptacle 11 and the keyed receptacle 10 of this invention. The keyed receptacle 10 has a keyed shell 14 and a keyed receptacle insert 15. A plurality of contacts 17 are arranged on parallel contact retaining walls on either side of an aperture 16 within the insert 15 in a fashion similar to prior art receptacles. Narrowed or reduced width end slots 19*a,b* at either end of the aperture 16 close out or block the wider ends 20*a,b* of a contact supporting tongue 21*a* of a plug insert 21 in the standard plug 13 shown in FIG. 3A. Shoulders 22 at which a width reduction occurs between the aperture 16 and slots 19*a,b* are positioned such that they define a length between shoulders less than the standard length of the aperture 23 of a prior art receptacle 11 or length of the tongue 21*a* of a prior art plug 13 to prevent insertion of standard plug 13. On the other hand, the outer ends of the slots 19*a,b* extend beyond ends 33*a* or 33*b* of the aperture 23 in a prior art receptacle 11 as shown in FIG. 2A and beyond the ends 20*a,b* of the prior art plug tongue 21*a* shown in FIG. 3A to receive the polarized plug 12 with its extended end portions 32*a* and 32*b*. Slots 19*a,b* include recesses 40*a,b* to accept raised portions 34*a,b* of plug 12.

The shell 14 of the receptacle of this invention has end keys 25*a,b,c,d* and side keys 26*a,b* shaped as convex outer bends in the shell 14 of the receptacle 10. These keys prevent mating with the standard plug 13 of FIG. 3A, even if the plug 13 is tipped in an attempt to insert one end of the plug in.

As shown most clearly in FIG. 4, the extensions or raised end portions 18*a* and 18*b* are provided at the slots 19*a* and 19*b* of FIG. 2B. These raised end portions begin at the shoulders 22 and extend to the outward ends of the receptacle 10. The projection of such raised portions prevents accidental arc-over of high voltages between the keyed receptacle 10 and a non-keyed plug 13 as shown in FIG. 1A.

Referring now to FIGS. 3A and 3B, a keyed plug 12 of this inventon will be compared to a non-keyed plug 13 of the prior art. The keyed plug 12 has a keyed plug shell 27 and a keyed tongue 28*a* on an insert 28. A plurality of contacts 30 are arranged in parallel rows on parallel walls of the tongue 28*a*. Insert extensions 31*a* and 31*b* extend from the ends of the tongue 28*a* and include ends 32*a* and 32*b* which protrude beyond ends 33*a* and 33*b* of aperture 23 in the standard receptacle 11 to prevent insertion of the polarized plug 12 into the standard receptacle 11 shown in FIG. 2A. On the other hand, extensions 31*a,b*, which begin at shoulders 37, are positioned such that they space the beginning points of the narrowed inserts 31*a,b* at a point less than the ends 20*a,b* of the tongue 21*a* of the prior art plug 13 or the ends 33*a,b* of the aperture 23 in the prior art receptacle 11 to receive the polarized receptacle 14. The base of insert 28 includes recessed end portions 41*a,b* to accept the raised portions 18*a,b* of the insert of receptacle 10.

As shown most clearly in FIG. 5, the extensions 31*a,b* have raised portions 34*a,b* which project above the top face of the tongue 28*a*. This prevents high voltage arc-over when an attempt is made to mate the keyed plug 12 with a non-keyed receptacle such as 11 shown in FIG. 2A.

End keyways 35*a,b,c,d* and side keyways 36*a,b* are provided on the shell 27 of plug 12 in order to mate with the corresponding keys 26*a,b* and 25*a,b,c,d* of the keyed shell 14 of receptacle 10 of FIG. 2B. These keys have an outward convex bend of slightly greater dimension than the corresponding keys of the receptacle 10 to permit smooth insertion thereover.

With the receptacle 10 and plug 12 of this invention, incorrect mating with standard plugs and receptacles is prevented by use of the narrowed slots 19*a,b* or the lengthened extensions 31*a,b*. Furthermore, the keys 25*a,b,c,d* and 26*a,b* of the shell 14 of receptacle 10 prevent mating of shell 14 with the shell of the standard plug 13 and prevent engagement of the end contacts by tipping of the plug 13. The raised, projecting portions 18*a,b* or 34*a,b* prevent high voltage arc-over between keyed and non-keyed connectors when a head-on insertion is attempted in addition to aiding in the separation of end contacts when the receptacle or plug is tipped towards the other connector part.

Typical dimensions for the slots 19*a,b* of the receptacle 10 of this invention is 0.09 inches nominal as compared to the width of the aperture which is about 0.16 inches. The additional height added by the projecting raised ends 18*a,b* or 34*a,b* is about 0.035 inches. Such elevation will prevent arc-over up to voltages of at least 1,000 volts. The above dimensions can be compared to the end-to-end length of the contact supporting tongue of the standard plug insert which is about 2.29 inches.

Although various minor modifications may be suggested by those versed in the art, it should be understood that we wish to embody within the scope of the patent warranted hereon, all such embodiments as reasonably and properly come within the scope of my contribution to the art.

We claim as our invention:

1. A connection system comprising: a keyed plug and matable keyed receptacle; a similar given standard receptacle and matable given standard plug each non-matable to the keyed plug and keyed receptacle, respectively; said given receptacle and plug each having a base means retaining a contact mounting insert with a given standard length contact supporting means defined by end walls spaced a given standard length by a contact supporting wall, said keyed plug and keyed receptacle each having (a) a base means;

(b) a contact mounting insert retained on the base means, said insert having contacts and a contact supporting means defined by end walls spaced by a contact supporting wall;

(c) keying means adjacent at least one end of the contact supporting wall, said keying means having a beginning portion means beginning at a point shorter than at least one end of the given standard length contact supporting means of the given standard receptacle and plug and terminating at an end portion means longer than said one end of the given standard length contact supporting means of the given standard receptacle and plug when the contacts of the keyed plug and receptacle are otherwise aligned for insertion with the otherwise matable contacts of the respective given receptacle and plug, said keyed plug and receptacle being otherwise matable with the given receptacle and plug but for the keying means;

(d) said keying means beginning portion means preventing mating between the keyed receptacle and the given standard plug; and (e) said keying means end portion means preventing mating between the keyed plug and the given standard receptacle.

2. The keyed plug and receptacle of claim 1 in which said keying means are provided at both ends of the contact supporting wall.

3. The keyed plug and receptacle of claim 1 in which the contact mounting insert has two spaced contact supporting walls and end walls, and said keying means for the keyed receptacle comprises a slot of width less than a spacing of said two contact supporting walls and the keying means for the keyed plug comprises an extended member formed to mate with said slot.

4. The keyed plug and receptacle of claim 1 in which said keying means has a raised portion extending above a top edge of the contact supporting wall.

5. The keyed plug and receptacle of claim 1 in which the base means has a shell with key means.

6. The keyed plug and receptacle of claim 5 in which said key means comprise portions of said shell bent in a convex shape.

7. The keyed plug and receptacle of claim 1 in which parallel rows of contacts are provided on parallel, spaced contact supporting walls of said contact supporting means.

8. The keyed plug and receptacle of claim 7 in which the spacing between the first and last contact of each contact supporting wall of the contact supporting means is the same as the spacing between the first and last contact on the walls of the standard length contact supporting means of the standard plug and receptacle.

9. A connection system, comprising: a keyed plug and matable keyed receptacle; a similar given standard receptacle and matable given standard plug each nonmatable to the keyed plug and keyed receptacle, respectively; the given and keyed plug and receptacle each having (a) a base means;

(b) a contact mounting insert retained on the base means, said insert having contacts and a contact supporting means defined by end walls spaced by a contact supporting wall;

the keyed plug and receptacle each having (a) keying means extending from at least one end wall, said keying means having a beginning portion means adjacent the end wall and an end portion means spaced from the end wall, said keyed plug and receptacle being otherwise matable with the given receptacle and plug but for the keying means;

(b) said keying means beginning portion means preventing mating between the keyed receptacle and the given standard plug; and (c) said keying means end portion means preventing mating between the keyed plug and the given standard receptacle.

* * * * *